US009117331B2

(12) United States Patent
Englman et al.

(10) Patent No.: US 9,117,331 B2
(45) Date of Patent: Aug. 25, 2015

(54) APPARATUS, SYSTEM, AND METHOD FOR RESPONSIBLE GAMING

(75) Inventors: Allon G Englman, Chicago, IL (US); Joel R. Jaffe, Glenview, IL (US); Jeremy M. Hornik, Chicago, IL (US); Vladimir I. Arezina, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 2050 days.

(21) Appl. No.: 12/295,595

(22) PCT Filed: Mar. 30, 2007

(86) PCT No.: PCT/US2007/007962

§ 371 (c)(1), (2), (4) Date: Sep. 30, 2008

(87) PCT Pub. No.: WO2007/123719

PCT Pub. Date: Nov. 1, 2007

(65) Prior Publication Data

US 2009/0176558 A1 Jul. 9, 2009

Related U.S. Application Data

(60) Provisional application No. 60/788,568, filed on Mar. 31, 2006.

(51) Int. Cl.

| | |
|---|---|
| ***A63F 9/00*** | (2006.01) |
| ***G07F 17/32*** | (2006.01) |
| ***G07F 17/34*** | (2006.01) |

(52) U.S. Cl.

CPC ..... *G07F 17/32* (2013.01); *G07F 17/3244* (2013.01); *G07F 17/34* (2013.01)

(58) Field of Classification Search

CPC ..... G07F 17/32

See application file for complete search history.

(56) References Cited

U.S. PATENT DOCUMENTS

| | | | | |
|---|---|---|---|---|
| 5,910,048 | A * | 6/1999 | Feinberg | 463/25 |
| 6,547,131 | B1 | 4/2003 | Foodman et al. | |
| 6,575,831 | B1 | 6/2003 | Gonen et al. | |
| 6,629,890 | B2 * | 10/2003 | Johnson | 463/25 |
| 7,473,179 | B2 * | 1/2009 | Xidos et al. | 463/29 |
| 7,828,645 | B2 * | 11/2010 | Walker et al. | 463/25 |
| 2002/0006214 | A1 | 1/2002 | Karlsson | |
| 2002/0128058 | A1 | 9/2002 | Rubeli | |
| 2002/0132660 | A1 * | 9/2002 | Taylor | 463/16 |

(Continued)

FOREIGN PATENT DOCUMENTS

| | | |
|---|---|---|
| EP | 1482459 | 12/2004 |
| WO | WO 01/40982 | 6/2001 |

(Continued)

OTHER PUBLICATIONS

Colonial Downs Phonebet:. Responsible Gaming. http://web.archive.org/web/20050209164133/http://www.cdphonebet.com/responsible_gaming_a.htm ; Feb. 9, 2005; 2 pages.

(Continued)

*Primary Examiner* — Seng H Lim

(74) *Attorney, Agent, or Firm* — Nixon Peabody LLP

(57) ABSTRACT

A method for promoting responsible wagering game play is provided which includes the acts of tracking a player's wagering losses and triggering a wagering restriction feature when the player's wagering losses exceed a predetermined loss limit and/or a predetermined loss rate.

30 Claims, 5 Drawing Sheets

(56) References Cited

U.S. PATENT DOCUMENTS

| | | | | |
|---|---|---|---|---|
| 2003/0013516 | A1* | 1/2003 | Walker et al. | 463/25 |
| 2003/0190944 | A1 | 10/2003 | Manfredi et al. | |
| 2003/0232647 | A1 | 12/2003 | Moser | |
| 2004/0053692 | A1 | 3/2004 | Chatigny et al. | |
| 2004/0121841 | A1 | 6/2004 | Xidos et al. | |
| 2005/0064938 | A1* | 3/2005 | Xidos et al. | 463/40 |
| 2005/0181870 | A1* | 8/2005 | Nguyen et al. | 463/29 |
| 2005/0282638 | A1* | 12/2005 | Rowe | 463/42 |
| 2006/0019745 | A1* | 1/2006 | Benbrahim | 463/29 |
| 2006/0189367 | A1 | 8/2006 | Nguyen et al. | |
| 2007/0015573 | A1* | 1/2007 | Angell et al. | 463/29 |
| 2007/0259709 | A1* | 11/2007 | Kelly et al. | 463/20 |
| 2007/0293306 | A1* | 12/2007 | Nee et al. | 463/25 |
| 2008/0188299 | A1* | 8/2008 | Angell et al. | 463/29 |
| 2008/0305853 | A1* | 12/2008 | Roitman | 463/25 |
| 2008/0318656 | A1* | 12/2008 | Walker et al. | 463/20 |

FOREIGN PATENT DOCUMENTS

| | | |
|---|---|---|
| WO | WO 01/63439 | 8/2001 |
| WO | WO 01/91038 | 11/2001 |
| WO | WO 03/042830 | 5/2003 |
| WO | WO 2004/056432 | 7/2004 |
| WO | WO 2007/044861 | 4/2007 |

OTHER PUBLICATIONS

International Search Report, PCT/US07/07962, dated Aug. 26, 2008, 2 pages.

* cited by examiner

APPARATUS, SYSTEM, AND METHOD FOR RESPONSIBLE GAMING

CROSS-REFERENCE TO RELATED APPLICATIONS

This application is a U.S. national phase of, and claims priority to, International Application No. PCT/US2007/007962 filed Mar. 30, 2007 which claims the benefit of priority of U.S. Provisional Patent Application No. 60/788,568, filed Mar. 31, 2006, both of which are incorporated by reference in their entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games, gaming machines, and methods for playing wagering games, and more particularly, to gaming systems for promoting responsible gaming.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Contrary to the above-noted commercial need for enhancing available games and wagering machines to attract frequent play and increase profitability to the operator, a countervailing interest is in promoting responsible wagering game play. In response to recent regulations in New Zealand, gaming machines are being configured to display pop-up windows, or the like, after half an hour of play informing the player of the duration of the player's session of play, the amount that the player has spend during such session, and the player's net wins and losses during such session, and further asking the player if he or she wants to continue.

In some jurisdictions, the local governments have taken cursory steps to promote responsible gaming including, but not limited to, 800 line help, advertising restrictions, alcohol service restrictions, credit restrictions, employee training, employee P.G. prevention, loss limit limited stakes, restrictions on marketing/direct mail, posters, signage, public awareness, self-exclusion, and treatment funding (e.g., by wagering proceeds). General restrictions and limitations on the placement of bets and amounts of bets, as well as the passive requirement to prominently display the odds of the game, for example, serve to indirectly provide a measure of responsible gaming.

However, despite the aforementioned efforts to promote responsible gaming, a need exists for more profound methods, systems, and devices for promoting responsible gaming and finding a socially responsible balance, at an individual level, between profitability to the gaming establishment and entertainment for the player.

SUMMARY OF THE INVENTION

According to at least some aspects of the present concepts, methods are provided for promoting responsible wagering game play. In one embodiment of such methods, a method for promoting responsible wagering game play is provided which includes the acts of tracking a wagering loss for a player and triggering a wagering-restriction feature when the wagering loss exceeds a predetermined loss limit and/or a predetermined loss rate.

In accord with at least some other aspects of the present concepts are provided gaming systems for playing a wagering game. In one embodiment of such gaming systems, a gaming system for playing a wagering game is provided which includes a player tracking device, an impairment monitoring device, and a controller comprising a wagering-loss-data counter. The player tracking device is configured to read player-tracking-data and identify a player and output the player identity to the controller, and the impairment monitoring device is configured to output impairment-monitoring-device-data to the controller.

Still other aspects of the present concept relate to wagering game machines. In another embodiment of a wagering game machine in accord with the present concepts, a wagering game machine includes an input device for receiving player tracking identifier data, the player tracking identifier data being associated with a predetermined loss limit. The wagering game machine also includes a controller communicatively associated with the input device and a memory bearing a wagering loss register and an instruction set. The instruction set causes the controller, upon execution, to compare the predetermined loss limit to the wagering loss register and to activate a wagering restricting feature when a loss indicated by the wagering loss register is at least equal to the predetermined loss limit. In still another embodiment of a wagering game machine in accord with the present concepts, a wagering game machine includes a controller and an impairment monitoring device configured to output a signal to at least one of the controller and an external device. In another aspect, the memory bearing the wagering loss register may comprise an external memory device such as, but not limited to, a memory device carried by a player identification card or device.

In yet other aspects, a method for promoting responsible wagering game play includes the acts of tracking a wagering loss relating to an account; triggering a wagering-restriction feature when the wagering loss exceeds a predetermined condition, and preventing wagers to be placed in association with said account until a reinstatement condition has been satisfied.

Still another aspect of the present concepts includes a method for promoting responsible wagering game play including the acts of tracking a wagering loss across a plurality of gaming mediums in association with a player identifier, triggering a wagering-restriction feature when the wagering loss exceeds a predetermined loss limit, and either preventing wagers to be placed in association with said account until a reinstatement condition with respect to said player identifier has been satisfied or limiting wagers placed in association with said account until a reinstatement condition with respect to said player identifier has been satisfied.

Additional aspects of the invention will be apparent to those of ordinary skill in the art in view of the detailed description of various embodiments, which is made with reference to the drawings, a brief description of which is provided below.

Figure 1A:
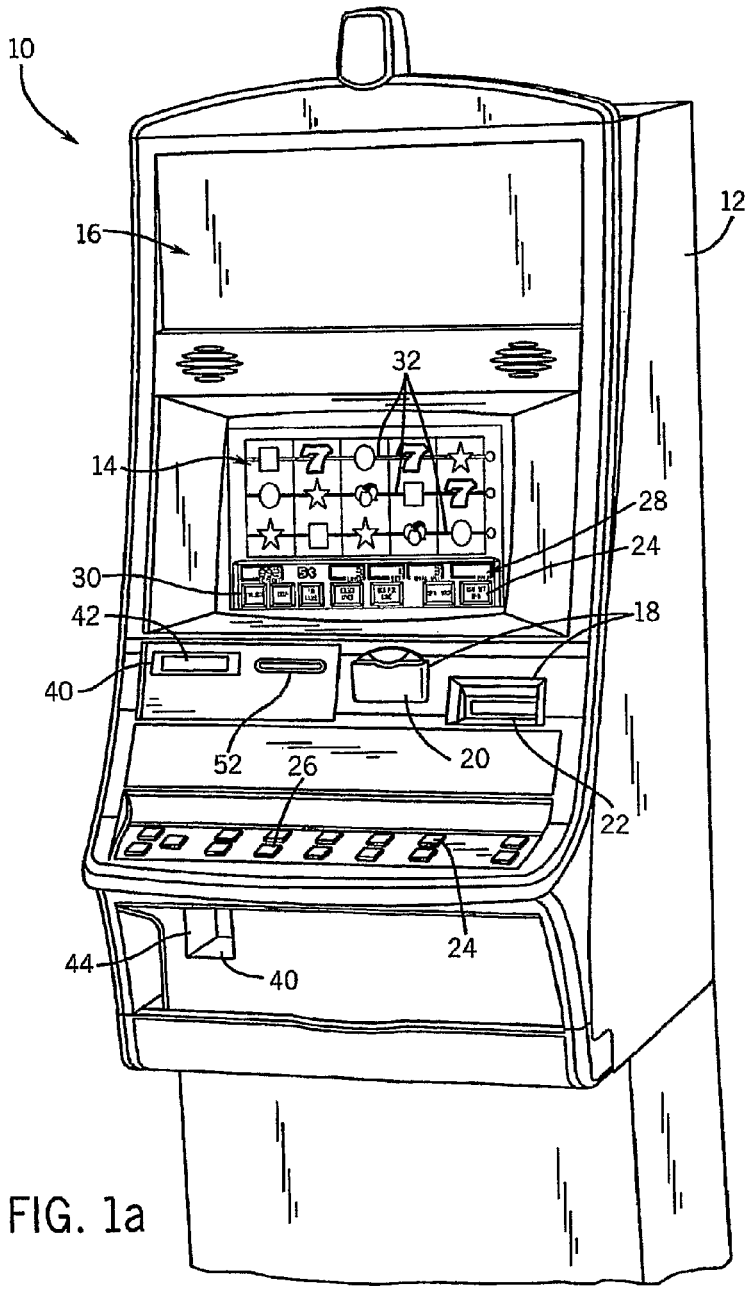
FIG. 1*a* is a perspective view of a free standing gaming machine embodying the present invention.

Additional aspects of the invention will be apparent to those of ordinary skill in the art in view of the detailed description of various embodiments, which is made with reference to the drawings, a brief description of which is provided below.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
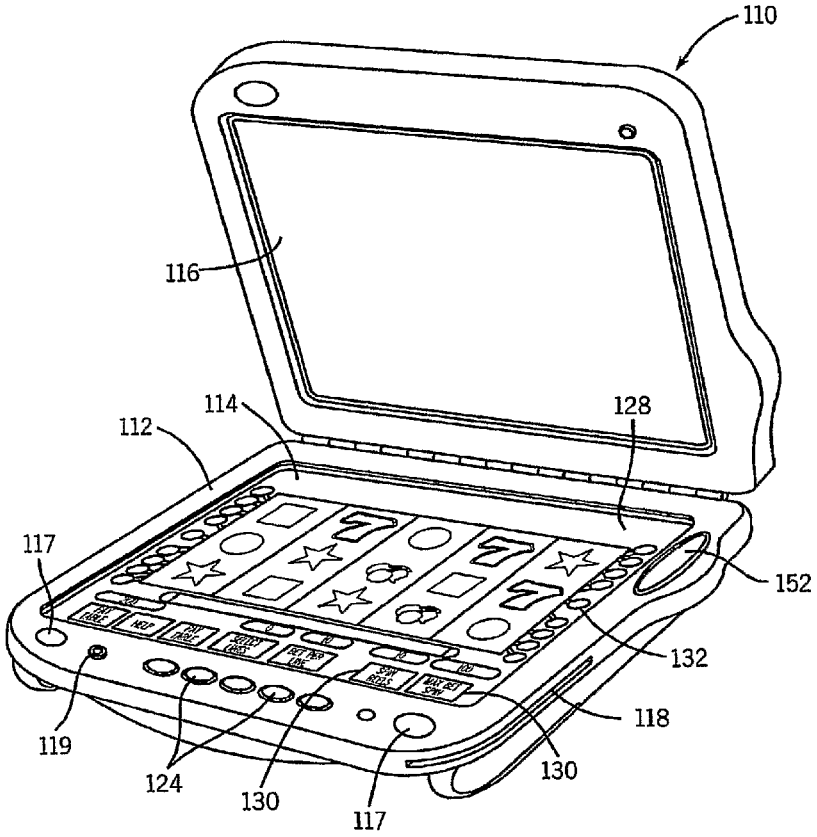
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
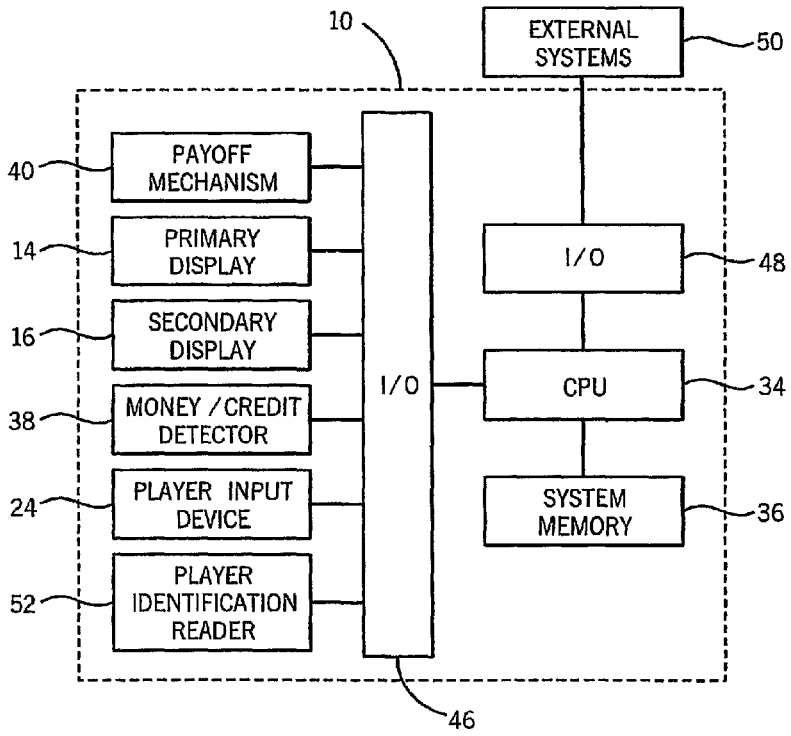
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device, primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
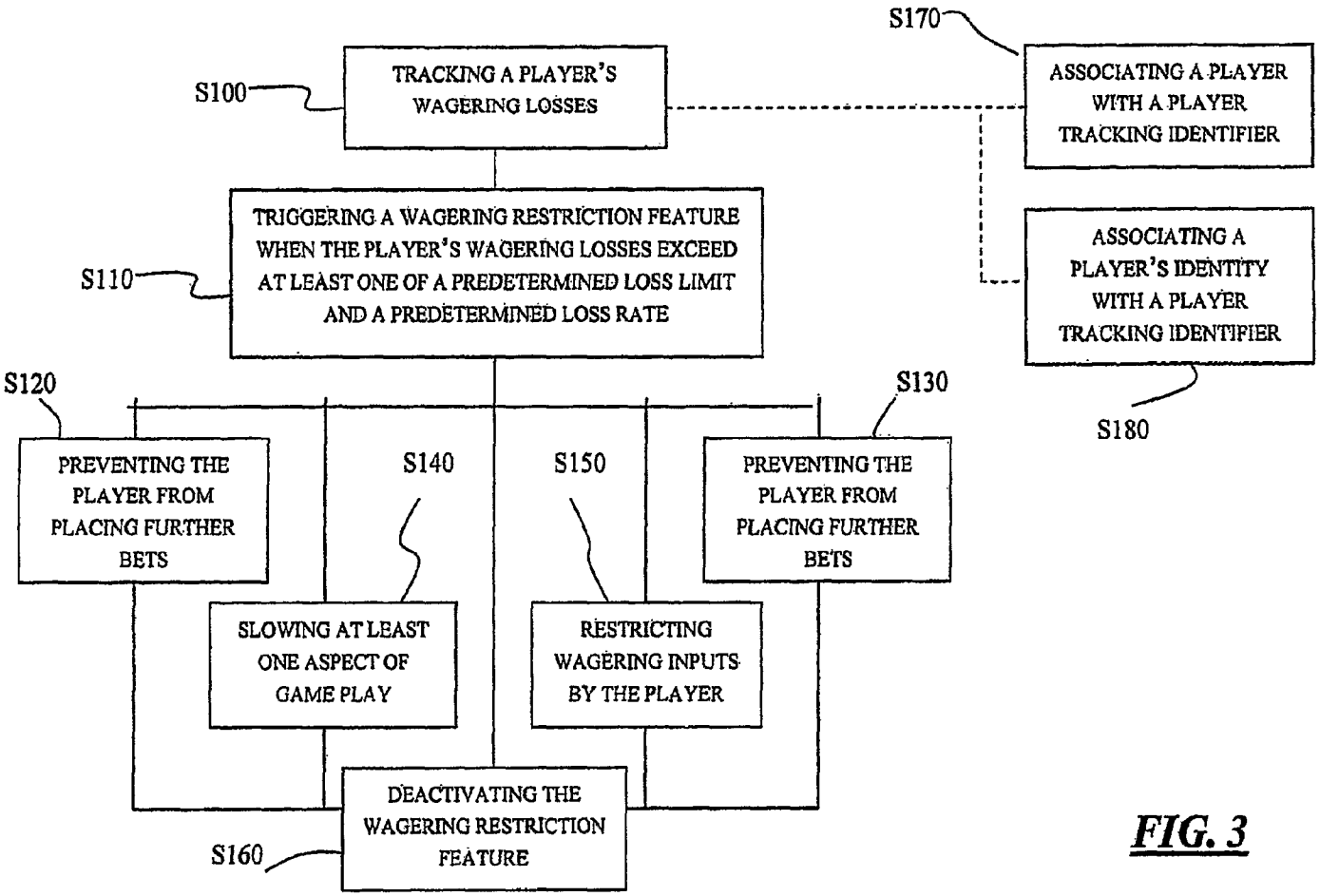
FIG. 3 depicts a flowchart of a method of promoting responsible gaming in accord with the present concepts.

In accord with at least some aspects of the present concepts for promoting responsible gaming, a method is depicted in FIG. 3 which promotes responsible wagering game play by tracking a player's wagering losses in Step 100 and triggering a wagering restriction feature when the player's wagering losses exceed at least one of a predetermined loss limit and a predetermined loss rate in Step 110. In response to the triggering of a wagering restriction feature in Step 110, the method may include the act of preventing the player from placing further bets (Step 120), the act of altering at least one aspect of game play to diminish an appeal of such aspect of game play (Step 130), the act of slowing at least one aspect of game play (Step 140), and/or the act of restricting wagering inputs by the player (Step 150). Further to any of Steps 100, 110, 120, 130, 140, and 150, the method may further include the act of deactivating the wagering restriction feature (Step 160). The deactivation of the wagering restriction feature in Step 160 may occur following satisfaction of a triggering event, which might include, for example, a lapse of a predetermined period of time and/or a satisfaction by said player of a predetermined action set by a gaming establishment. Further aspects of the method depicted in FIG. 3 include, for any of the aforementioned steps, associating a player with a player tracking identifier (Step 170) and/or associating a player's identity with a player tracking identifier (Step 180). The above method is advantageously implemented in association with a wagering game machine 10.

Accordingly, a wagering restriction feature to promote responsible gaming in accord with the present concepts may comprise active measures which, for example, prevent the player from placing further bets, restrict at least one aspect of wagering, cause at least one aspect of game play to be altered so as to diminish the appeal of such aspect of game play, and/or slow at least one aspect of game play. The wagering restriction feature may also comprise more passive measures which, for example, remind a player of an upcoming, satisfied, and/or exceeded predetermined criteria, but do not otherwise limit a player's actions. Reminders may include, but are not limited to, display of warnings that the loss limit set by the player and/or the gaming establishment has been exceeded or is soon likely to be exceeded, display of losses, display of odds of recouping losses over a specified period of time, and/or display of material representations of a player's losses. Additional non-limiting examples of wagering restriction features and reminders illustrative of the present concepts are provided herein.

The trigger for the wagering restriction feature may be, in at least some aspects, associated with a player tracking feature, such as a player tracking card, credit or debit card, screen name, player's biometric data (e.g., fingerprint, retinal characteristics, voice pattern, measured weight, etc.), and/or other identifier. In other words, the noted predetermined criteria (e.g., a loss limit) is directly associated to a player tracking feature. The player tracking feature need not be linked to an actual identity of a player (i.e., an identified player), but may be optionally associated with a randomly assigned player tracking number assigned to a player (i.e., an unidentified player).

The trigger for the wagering restriction feature alternatively may be independent of any player tracking feature. For example, the trigger may arise from a trending analysis of wagering data and loss data for a particular wagering game machine 10 for a gaming session. The starting point and ending point of a particular gaming session may be determined independently of player input of player tracking data, for example, by a substantially continuous succession of plays, activation/deactivation of a switch or sensor adapted to determine the presence of a player (e.g., a motion detector, a thermal detector, a switch in the seat to detect a player standing up or sitting down, etc.), input of a credit card or wagering device bearing a name different than that of a prior player, or by comparison of biometric data on a periodic basis (e.g., every minute) or an a causal basis (e.g., following a pause in wagering of more than a predetermined period of time or in conjunction with an activation of another sensor or switch). For example, the player tracking data monitored by a wagering game machine 10 and/or external system could consist of a scale integrated into the chair or seat of the wagering game machine, such scale being configured to output a signal or for polling by another system. If a measured weight of a player on the seat is 215 pounds at 5:21 P.M. and is 146 pounds at 5:22 P.M., then a controller (e.g., controller 34) can assign a starting point for a gaming session at 5:22 P.M. or may further analyze the wagering data between 5:21 P.M. and 5:22 P.M. to more accurately assess a starting time. The wagering restriction feature may also comprise combinations of active measures and passive measures.

In at least one aspect of the above concepts, responsible wagering game play may be facilitated by persuading or requesting a player to self-identify a problem or limit(s) to a gaming establishment. The gaming establishment would then monitor the player's wagering activities and intervene, in accord with the player's request (e.g., a pre-determined loss limit), with any one of a plurality of requested actions (e.g., reminders of increasing frequency and/or urgency, a warning followed by a cut-off, etc.). The player tracking may optionally be limited to one particular type of wagering game (e.g., slot based games, gaming machines, etc.) or may encompass all wagering activities at the gaming establishment. For example, the gaming establishment may elect to limit the monitoring for responsible wagering game play to selected wagering activities than are more readily monitored and tracked, such as electronic gaming devices. The gaming establishment's monitoring of identified or unidentified players toward the end of promoting responsible wagering gaming need not be, and is preferably not limited to, a player's request for such monitoring and intervention, and may be exercised independently of any request by a player.

In one example, a player could associate a loss limit of $500 to a player's player tracking feature, such as a player tracking card or biometric characteristic, for a subsequent time period (e.g., a 1-hour, 12-hour, 24-hour, or any other period). In response to this request by the player, the gaming establishment could issue a reminder (e.g., a pop-up window on a wagering game machine 10 or a message to a dealer to communicate to the player) to the player at a predetermined loss limit below the specified threshold, such as $400, to remind them of the limit. Another reminder could be subsequently issued at a second predetermined loss limit below the specified threshold, such as $450. In accord with one aspect of the present concepts, at the specified threshold, the player may be entirely prohibited from placing any further wagers. In another aspect, the player account may be provided with an incremented loss limit of, for example, $200/hr for a subsequent 6-hour period of wagering game play or a rolling loss limit of $200 for any 60 minute period of wagering game play. In the former example, a player exceeding the threshold loss limit may, in one aspect, have their player account and wagering capability in association therewith suspended temporarily until the loss limit threshold condition has cleared. In an alternative embodiment, a gaming establishment could associate a loss limit of any desired amount (e.g., $500, $1000, $1500, etc.) to a player tracking identifier for a predetermined time period.

Alternatively, instead of time limits or loss limits, other types of limits may be imposed. In various examples, such triggers could include a "coin-in limit" or "value-in limit" (e.g., based on how much money is put into the machine or otherwise wagered), an "amount bet limit" (e.g., based on each bet made, regardless of how much money is inserted), and/or a "win limit" (e.g., based on an amount won). Thus, taking the last example, for instance, a mandatory cool down period may be imposed for wins exceeding a certain absolute threshold or relative threshold (e.g., based on wagering levels).

The aforementioned reminder may, in at least some aspects of the present concepts, comprise a visible meter that tracks a player's losses and/or wins, or data relating thereto (e.g., an amount remaining until a predetermined loss limit is satisfied/exceeded). The player's losses and/or wins, or data relating thereto, may be tracked and/or displayed for any predetermined time period, such as a period of minutes, hours, days, weeks, months, year, or years. In other aspects, the player's losses and/or wins, or data relating thereto, may be tracked for a single gaming session, regardless of time period. Not only does a loss-meter inform the player about losses over a predetermined period of time or during a gaming session, but it also displays such information to observers of the player's wagering games. This public display of loss information may itself serve to temper a player's continued play. Alternatively, the loss meter may not be continuously displayed, but may rather be accessible for a player to view and may include various statistics, or graphical representations thereof, about the player's wagering activities.

In still other aspects of the present concepts, the "real odds" of any given machine may be prominently displayed to the player. For example, the controller 34 could cause the display to display a message stating that "If you put $20 into this machine and bet a dollar every time, your chance of being up at the end of this time is xx%" or words to that effect. In this way, the odds of the player being up at the end of a gaming session (e.g. an arbitrary unit of time such as one hour) or for an amount wagered. In many instances, players are not cognizant of or mindful of the concept of volatility and players flock to the biggest payoff machine, while failing to appreciate that the frequency of payoffs for such games are lower than for machines having lesser payoffs. For example, if a casino says "we pay 88% of all bets placed," many players find the odds acceptable, if not attractive. In accord with at least some aspects of the present concepts, the message to the players or prospective players is not to entice, but to inform. The above message of an 88% win or return percentage could, for example, be reformulated into "for every $100 wagered, you will, on average, be left with only $88" or "for every $100 wagered, you will, on average, lose $12." In at least some other aspects, the controller 34 might display a pre-emptive warning tailored to the player's recent history or past history. For example, the controller 34 might display to the player that, "based on your recent rate of play and wagering, you are expected to lose $34 over the next 30 minutes." Thus, even if a player has just received a payoff, emboldening the player to continue playing, the warning will serve to viscerally remind the player of the real odds of continued play. This type of message could be periodic (e.g., every 15 minutes), random, or triggered in response to a predetermined event (e.g., after every payout). The message could also or alternatively inform of any other feature of game play which might educate the player of the odds of each play, the chance of hitting a particular feature, and, in general, the probability that the player will lose money.

Another embodiment could display a statement informing the player of the actual odds of triggering a bonus game, or the like. Many players play particular wagering game machines because they like the game feature(s), not because they like the basic wagering game, which is generally similar from machine to machine in many instances (e.g., spinning symbol-bearing reels). However, most players have no idea of how often the game feature is really initiated. The game feature could, for example, occur about once every 160 spins. When a player has played for 200 spins and still has not obtained entry into the game feature, the player naturally develops an expectation that the game feature "has to" occur soon. In accord with the present concepts, a reminder (e.g., a pop-up window) may inform the player that the chance of obtaining the bonus is "still" 1 in 160. Thus, the wagering game machine 10 could remind the player of the real odds to counter a player's possible perception that the player's odds are "improving" with continued play. In other aspects, the reminder may comprise a continuously displayed graphic informing the player of the chances of achieving a particular outcome. In this latter embodiment, wagering games need not be stopped in progress.

In still other examples, the aforementioned reminder may, in at least some aspects of the present concepts, comprise a textual message, pop-up window, image, our audio output that converts a player's losses and/or wins into a concrete representation of the player's losses and/or wins in merchandise, goods, services, or other tangible benefits. In this respect, the player is confronted not with odds or statistics, but with visual representations of merchandise that they could have purchased, but for the wagering. Thus, a player having lost $2500 over the course of a year might be confronted with images of merchandise or goods having a value of approximately $2500 (e.g., a wide-screen plasma TV, a desk-top computer, a first-class plane ticket to Hawaii, etc.). The controller 34 could, for example, display any one of a plurality of such images and could randomly or sequentially cycle through such images. In another aspect, such a reminder could simply comprise tracking of losses over one or more gaming sessions (e.g., a weekly, monthly, or annual tally of running losses and/or graphical representations of wagering, such as graphs, charts, and/or calenders).

In another example of a reminder which could promote responsible wagering game play could include a reminder after every play of how much the player just wagered and lost, the aforementioned reminder could comprise a pop-up window or image that displays not how much a player has won from a predetermined random event, but rather the actual payoff amount. In other words, contrary to a posted payoff amount which shows the payoff for a particular triggering event, the actual payoff amount is the amount associated with the predetermined random event (e.g., the posted amount) minus the immediately preceding bet placed by the player to obtain the payoff or minus the collective bets placed by the player to obtain the payoff (e.g., the total bets placed by the player since the start of play or since the last payoff for the player). Typically, a win meter displayed on the primary display 14 would depict only the amount won by the player. For example, assuming an initial win meter of zero and an initial bet of 20 credits, a "win" of 10 credits could be displayed as "Win 10," or the like, even though the player just suffered a net loss of 10 credits. Thus, contrary to conventional systems which emphasize the positive, the present concepts include an embodiment where the display of the net win is offset by the immediately preceding wager to show the net results of each play or spin. In this example, if a player loses the play or spin completely (i.e., no payout), then instead of a message similar to "try again" or "game over," the controller 34 could display a message of "x credits lost this turn," where x is any integer representing a wager.

In another example of a reminder which could promote responsible wagering game play could include an audible reminder or audible component to other types of reminders. In an example where a player bets 25 credits and wins 10 credits, the screen could display "Net loss=15 credits," or the like, and the "win" meter or other credit tracking mechanism could be audibly decremented downwardly to reflect the net loss. Thus, instead of the typical banging bells, beeps, chirps, or other noises associated with a win (e.g., "bang up" noises), another type of noise (e.g., "bang down" noise) can be associated with a loss. To illustrate, on a conventional wagering game machine, if a player has 420 credits on their credit meter and they bet 20 credits, the credit meter will quietly and instantly just do down to 400 credits. If the player then wins, the credit meter will increment upwardly from 400 to 410, banging up with a winning noise for each upward credit increment and displaying graphics to highlight the winning event. Thus, the wagering game machine draws attention to the win, but not the loss. The player does not conventionally see the same attendant hoopla when money is taken away. In accord with at least some aspects of the present concepts, the loss of money could be highlighted to the player. The visual and/or auditory highlighting of a loss need not necessary be subject to the same level as that associated with a win, and could provide a more muted response in at least some embodiments. In other embodiments, the visual and/or auditory highlighting of a loss could be greater than that associated with a win. In still other embodiments, the visual and/or auditory highlighting of a loss and/or a win could be proportional to the amount of the win and/or loss (e.g., a comparatively large loss on a wagering game machine, such as a MaxBet, would result in a greater or more pronounced audio/video output from the wagering game machine 10 than a loss of 1 credit or 5 credits).

In other embodiments wherein a wagering game machine 10 is configured to display a reminder, such as described above, the reminder could be configured to inform the player (e.g., via a pop-up, continuous graphical element, etc.) of how long they have been playing on a given machine or in a gaming session.

Another embodiment of a wagering game machine 10 in accord with the present concepts could comprise a reminder configured to display to the player via text and/or graphics the actual odds of hitting a game feature, the odds of breaking even on a specific bet, the odds of breaking even over a predetermined period of time in accord with an immediately preceding bet history, a probability that the player will break even at any future time, and/or an "average pay back" at a given point. The controller 34 and/or game control system can evaluate the player's speed of play, average bet, wagering pattern, odds, and provide forecasts for the player on the primary display 14, secondary display 16, or other output device (e.g., audio output). Thus, the controller 34 could provide messages to the player including, but not limited to "Based on available data, you are estimated to lose your available credits in 30 minutes" or "You have $828 dollars. If you play at this rate, you are expected to lose this money in two hours and forty-eight minutes." The controller 34 could cause an hourly loss meter to be displayed to show the player a relative measure of the expected loss per hour based on play speed and wagering.

Concurrent with or separate to the above informational displays, a wagering restriction feature may be adapted to "lock out" the ability of a player to increase his or her bet for a predetermined period of time, or until a predetermined criteria has been satisfied or cleared, if his or her odds of breaking even are below a certain threshold or if his or her losses exceed a predetermined threshold. This would prevent the player from increasing his or her bet to chase his or her losses (e.g., doubling bets in hope of winning back losses). Likewise, in at least some other aspects, the wagering restriction feature may limit the player's bets, such as by preventing the player from placing MaxBets and forcing the player to wager on less than a predetermined number of paylines (e.g., 1, 2, 3, 4, 5, 6, 7, etc.). For example, the wagering restriction feature may limit the player to wagers placed on, at most, four pay lines until a condition triggering the wagering restriction feature is removed.

In accord with at least some other aspects of the present concepts for promoting responsible gaming, game play itself may be slowed. The slowing of the wagering game may involve any aspect of wagering game play including, for example, the input of the wager, the play of the wagering game, the indication of wins or losses, and/or the refresh or wait time between successive plays of a game. For example, in conventional wagering game machines, a playing scoring a winning outcome is permitted to "bang through" a win by pressing one or more player inputs (e.g., via push buttons 26) to avoid or bypass the graphics that normally accompany the winning outcome. In this way, the player can immediately proceed to play the next game. In accord with at least some aspects of the present concepts, the player would be prevented from bypassing the graphics which accompany the winning outcome Accordingly, a mandatory waiting period corresponding to the cycle time required for the winning outcome graphics would be imposed between a player's win and a player's next wager. In at least one aspect, the cycle time of graphics accompanying the winning outcome could be increased for higher valued winning outcomes so as to cause the player's winning comparatively larger amounts to "cool down" slightly more than a player winning a comparatively smaller amount. In other examples, the wagering game play itself may be slowed. In other aspects, a wagering restriction feature for a wagering game machine 10 may be configured to stop a wagering game or bonus game in progress (e.g., stopping the reels in the middle of a spin, or interrupting a deal of a hand of cards) and to interrupt the player's game play with a reminder, such as noted above.

In an example of a slots-type wagering gaming machine, the above embodiment could include, but is not limited to, making the reels spin more slowly, making the starting of the spinning occur more slowly, making the stopping of the reels slower, and/or making the spinning of the reels last longer. The above-noted measures for slowing game play and/or wagering could be uniformly applied to all players or selectively applied only to selected identified players requesting such intervention by the gaming establishment. The above-noted measures for slowing game play and/or wagering could be applied proportionally, slowing the game in correspondence with increasing player losses. For example, if a conventional reel spin were to be 3 seconds, the wagering game machine 10 could be configured to increase the reel spin time to 4 seconds at an identified player loss of 400 credits or other predetermined limit, increase the spin time to 5 seconds at an identified player loss of 800 credits or other predetermined limit, and so on. Alternatively, or in combination therewith, if a conventional reel stop sequence was to have a ½ second gap between stopping of each reel may be increased to 1 second at an identified player loss of 400 credits or other predetermined limit, and may be further increased to 1.5 seconds at an identified player loss of 800 credits or other predetermined limit, and so on. Still further, a mandatory waiting period (e.g., 0 seconds-10 seconds) may be imposed between each spin. In accord with this example, the time could be decremented back down if the player's winnings begin to offset the losses and carry the player back across the above thresholds, or any other arbitrarily determined threshold (e.g., the timing of the game could be reset if the player eliminates his or her losses).

The above-noted measures for slowing game play and/or wagering could be applied on an anonymous basis to slow down play on a particular machine based on the controller's and game control system's analysis of wagering game data or on a player-specific basis based on a player identity or player tracker. In the former case, a player could elect to move to a different wagering game machine 10 that is not slowed in response to the player's session losses. This movement of the player does not defeat the goal of promoting responsible gaming because the mere fact that the player has to take a moment to move to another wagering game machine 10 forces the player to make decisions about what wagering game machine to go to, whether or not to continue playing the same wagering game machine or to select a different type of wagering game machine, etcetera. The player's movement thus interrupts the flow of wagering. In the latter case of a specific player being tracked, movement to another wagering game machine would initiate an identical slow down in any selected wagering game machine.

In accord with at least some other aspects of the present concepts for promoting responsible gaming, gaming establishments could require all players to use a player tracking identifier that enables restrictions to be applied to the wagering by the player. The player tracking identifier could be anonymous, associating unidentified players to randomly generated numbers or codes, or could optionally be linked to or associated with a player's identity and/or personal information. The tracking of losses experienced by each of the gaming establishment's players and/or wagering data (e.g., history, patterns, etc.) would permit friendly intervention on the player's behalf, to promote responsible gaming thereby in accord with any of the examples and concepts disclosed herein.

In accord with the present concepts, a gaming establishment could offer both types of player tracking, anonymous tracking for those who prefer anonymity and identified player tracking for those players who would prefer to obtain the comps and benefits offered by the gaming establishment for such additional information. In some instances, the casino could tie the measures taken to promote responsible gaming to the player tracking identifiers and could tier the loss limits and actions taken based on the tier of player tracking. For example, players who chose to remain anonymous could receive a silver player tracking card, token, code, RFID, or the like, which is associated with a low loss limit (e.g., $500 over a predetermined period of time). The loss limit for the player tracking identifier, whatever the form, could comprise any one of a plurality of loss limits, time limits, and preferences and are not limited thereby. Players who are willing to reveal their identity and financial information (e.g., available credit, credit limits, credit history, salary/income verification, tax returns, etc.), or who are willing to place a predetermined amount of money in escrow (i.e., $1000 to be returned to player) or to be applied directly to gambling losses, may be eligible for a player tracking card, or the like, which is associated with a loss limit that is at least roughly commensurate with the player's financial status and/or escrow. In this way, players having the financial means may be subject to measures for promoting responsible gaming in correspondence to their status. For example, a player making a million dollars a year can afford to wager larger than typical amounts and a loss limit of $500/hr could be unduly restrictive for such player and a loss limit of $5000/hr may be more appropriate.

In still other aspects, the casino may require players to deposit, in advance, all of the money that a player intends to wager during a trip or visit When that money has been depleted, the player may be prevented from further wagering or may be prevented from wagering following satisfaction of a precondition or preconditions. In this way, player's are forced to decide, up front, how much of a loss (if any) they are willing to sustain and reduces the potential for a player to emotionally reassess their risk tolerance. The precondition(s) could include, but are not limited to, a detailed financial review (e.g., credit history), buy-in by a spouse, an interview with a gambling counselor, lapse of a pre-determined cooling off period (e.g., 12-hours, 24-hours, etc.).

In accord with at least some other aspects of the present concepts for promoting responsible gaming, wagering game machines could be configured to, upon a player's reaching of a predetermined loss limit or other predetermined criteria indicative of a wagering issue, the controller 34 and/or game control system could cause to be displayed on the primary display a video clip or commercial directed to the promotion of responsible gaming. The video clip could be blunt, such as a 15-second video clip of a man leaving his gaming machine, looking in his empty wallet, being denied credit, and as he searches through his wallet looking for something of value, looks and gazes at a picture of his loving family. The video clip could also be subtle, such as a 10-second video clip showing a player hitting their loss limit, getting up from the wagering gaming machine, going over to get some dinner, looking at their watch, at then resume gaming at a later time. The subtlety of the message could optionally be geared toward the wagering history of the player and could become increasingly direct if it becomes apparent or likely that the player's wagering history indicates a problem might exist. In accord with any of these aspects, the video reminder could be set up to interrupt a spin or bonus so that the player is made to sit through the video to see the result of their game.

In accord with at least some other aspects of the present concepts for promoting responsible gaming, wagering game machines could be configured to, upon a player's reaching of a predetermined loss limit or other predetermined criteria indicative of a wagering issue, the controller 34 and/or game control system could cause to be displayed on the primary display interactive windows which ask the player questions which, if the player's answers indicate a potential problem with responsible gaming, a video link, audio link, and/or textual link is established between the player and a live counseling service or virtual counseling service. Thus, the player may be directly provided counseling services through the wagering game machine. Alternatively, the player's answers may be keyed to specific textual messages video clips, and/or messages that provide counseling advise pertinent to the player's specific answers and/or pertinent generally a set of answers provided by the player. In one aspect, the player may even enter a text message or pre-select a message, video clip, or the like, for display upon the occurrence of a criteria (or set of criteria) set by the player. For example, the player may request that when his or her losses reach $250, the player's own message will be displayed stating "If you lose $250, you are heading to the swimming pool!". In one aspect, the message could be configured to "cash out" the remaining credits, if any, to the player's account for later disposition and optionally temporarily disable the gaming machine 10 on which the player is playing (e.g., for 15 seconds, 30 seconds, 1 minute, etc.).

Some other aspects of the present concepts for promoting responsible gaming include a wagering game machine 10 configured to provide, upon a player's reaching of a predetermined loss limit, a chance to obtain a consolation prize through a repeat play or plays of the wagering game or by play of another game such as, but not limited to, a secondary bonus game. In one embodiment, the consolation prize would consist of a free casino service (e.g., a ticket to a show, a dinner, a spa service, comp, gift card, etc.) or discount or coupon for such service. For example, a player loses $500 over two hours and, prior to having his or her gaming temporarily suspended, is offered the chance to obtain a consolation prize (e.g., the attainment of the loss limit serving as a trigger for a consolation bonus game). The player plays a consolation prize bonus game and gets a $50 coupon for application to a gaming establishment restaurant. The discount, coupon or service, could be time-limited (i.e., it must be redeemed within a specified period of time—1 hour, 2 hours, etc.) or could be open-ended. If the discount, coupon or service, could be time-limited, responsible gaming is further promoted by encouraging the player to leave the wagering game machine 10 or wagering game tables and perform some other activity after a predetermined loss limit has been reached. At the very least, the playing of a consolation prize bonus game takes up some of the player's time that the player might have possibly tried to use to place another wager.

In another embodiment, responsible gaming may be promoted by simply provided a time-delayed rebate to the player. After a player reaches a predetermined loss limit, the gaming establishment would provide an equivalent of a post-dated check rebating part of the player's losses. For example, for identified players, the gaming establishment could mail a check to the house of the player with the accrued rebates (e.g., $20 or $50 for every $500 lost). Since the money is not made immediately available to the player, the player is prevented from losing as much money as they otherwise would have under a conventional system. Conditions may also be imposed on the rebate. For example, the rebate could be higher (e.g., $75 for a $500 loss) if the player doesn't play again for a long predetermined time period (e.g. 12-hours or 24-hours) and lower (e.g., $25 for a $500 loss) if the player plays again after a relatively short predetermined time period (e.g. 30 minutes).

The above-noted rebate need not be a check and may assume any form in which a value may be stored (e.g., a security paper voucher, a magnetic card, a code or condition associated with the player's identity or identification number) and redeemed by the player at a later, predetermined time. In one embodiment, instead of the rebate comprising bearer paper redeemable by any presenter, the rebate might be made to be redeemable only by the named player, so as to avoid a secondary market in rebate checks, vouchers, cards, etc. The predetermined time may be, but is not limited to, a period of minutes, hours, or days calculated to delay delivery of the rebate to the player. Accordingly, the player may be permitted to immediately take possession of the physical rebate medium or may be informed of an electronic association of the rebate with the player's identity or identification number, but the player would be prevented from immediately accessing such money or putting such money back into the wagering game machines.

In other aspects, the rebate may be credited to the player's credit card or deposited to a player's bank account. Although this measure does not provide insurmountable barriers to the player's access to the funds, it does add one additional step. The promoting of responsible gaming may be served by the adding of one additional step, which requires the player to take an action which imposes a barrier, albeit temporary, to additional wagering by the player.

In still other aspects, the wagering game machine 10 may be presented with options for the form and timing of the issuance of the rebate or receipt of the player's winnings. In other words, this concept may apply generally to any winnings and is not necessary to loss limits or any of the other concepts disclosed herein regarding promotion of responsible gaming. In some instances, the player may be invited to obtain an incentive to delay receiving the rebate and/or winnings. For example, if a player wins a large jackpot, regardless of any loss limit, the player may be provide the opportunities of (1) "Have the winnings delivered to your house (or deposited in a specified account) tomorrow morning at 9 a.m." or (2) "Have the winnings delivered to your house (or deposited in a specified account) in 3 months, with an added 2% interest." In accord with the "win limit" trigger noted above, a player exceeding a certain "win limit" may be prevented from receiving any cash-based winnings (e.g., currency, credit, tokens, etc.) for a predetermined period of time and, if the player elects to continue gambling, any wins during such predetermined period of time may be awarded in the form of vouchers that must be spent on goods and/or services (e.g., buffet, rooms, etc.)

Figure 4:
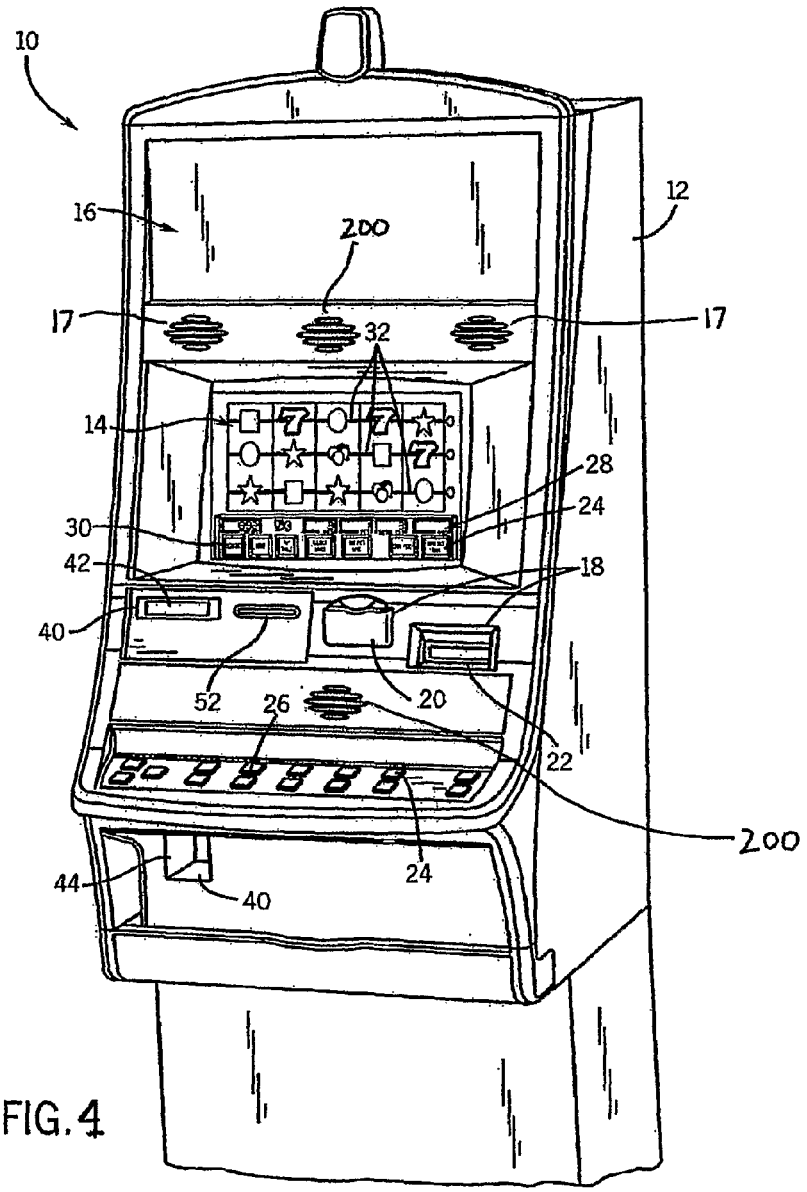
FIG. 4 is a perspective view of a gaming machine which may be utilized in accord with the present concepts.

The present concepts relating to promoting responsible game play may also include incorporation of systems, software, and/or devices in the wagering game machine, in the vicinity thereof, or in the gaming establishment or associated computer system(s) or network, that attempt to gauge the physical and/or mental condition of the player, such as, but not limited to, an impairment monitoring device 200, such as is represented in FIG. 4.

In one example, the gaming establishment's employees (e.g., bartender, waiter, waitress, etc.) could track the number of alcoholic beverages provided to a player and optionally other variables such as rate of consumption of the alcoholic beverages and the time at which the alcoholic beverages were provided, and input or associate that information to a player tracking system to attempt to prevent the player from becoming too impaired while wagering. This system could advantageously be integrated with information on an identified player's weight, so as to appropriately correlate a player's body weight, rate of metabolizing alcohol (e.g., one drink per hour), and alcohol consumption. In another aspect, the wagering game machine 10 seats (not shown) could be equipped with a scale to determine or estimate an identified or unidentified player's weight.

An example of an impairment monitoring device 200 depicted in FIG. 4 could include an alcohol vapor sensing device that continuously samples the air around the player and, following compilation of data indicating that a player may be intoxicated, the wagering game machine 10 could notify the gaming establishment with a request to send an employee to come chat with the player to generally assess the player's condition. Alcohol vapor sensing devices include, but are not limited to the Alco-Sensor, manufactured by Intoximeter Inc., and the PAS IV Passive Alcohol Sensor "Sniffer" and the P.A.S. Vr. Alcohol Screening & Verification System manufactured by PAS Systems International of Fredericksburg, Va. The University of Texas at Arlington has also recently developed alcohol vapor sensing technology utilizing a sensing component comprising a microelectronic fuel cell that catalytically converts ethyl alcohol, the intoxicating ingredient in alcoholic beverages, into water and carbon dioxide. The sensor developed by the University of Texas at Arlington is purportedly about the size of an inch-thick half dollar coin, will cost between about $25 to $50, and may be imbedded within the wagering game machine 10 with perforations therein permitting vapor exhaled by the player to reach the sensor. The gaming establishment could establish its own criteria for restricting wagering for potentially impaired players and need not follow any standards enforced by local authorities against persons operating motor vehicles. For example, the gaming establishment could restrict wagering for players having an estimated blood alcohol content (BAC) above a threshold of about 0.15, 0.20, 0.25, etc. Optionally, the impairment monitoring device 200 could be configured to only output a signal to a controller 34 and/or external system if the measured BAC meets or exceeds the predetermined threshold.

Active systems could also be employed. For example, the wagering game machine 10 could flash a strobe, which may be provided as part of the wagering game graphical display, and a sensor positioned to monitor the player's pupils could observe the pupils and output information thereon to the controller, which may then attempt to determine whether the eye dilation time response is within generally normal limits or is decreasing over time.

Another active system might include a reflex test. The player'response times may be compared to historical values for an identified player, recent response times for an unidentified player having a player tracking identifier associated therewith, recent response times for an unidentified player playing a single machine for a gaming session lasting more than a predetermined period of time (e.g., 1 hours, 2 hours, etc.). Thus, since individual response times vary, the player would preferably be compared to past data for the player. Absent any historical data, the wagering game machine 10 might merely identify any reflex times which are sufficiently outside a statistical measure of a general populations normal response time (e.g., $1\sigma$, $2\sigma$, $3\sigma$) to merit follow-up (e.g., visual verification, a discussion with the player by an employee, etc.) to determine, for example, whether the poor reflex time is attributable to a 90-year old person with poor reflexes or a chemically-impaired person. The reflex test could comprise any measured response time by the player to an event. In one example, the player could be instructed to put a finger on a player input device (e.g., a push button 26) and push the button when a predetermined event occurs (e.g., the instruction box disappears, an image appears, etc. In another example, the player may be confronted with a sequence of required inputs and the player's accuracy as well as completion time could be evaluated for indications of impairment.

Still another active system might involve monitoring of a player's mental and physical state and, if impairment is suspected, require the player to agree to perform an on-site urinalysis test, or other form of testing (e.g., conventional breathalyzer), to continue wagering.

In still other embodiments, responsible gaming could be promoted by discounting a player's repeated buy ins after the player has reached a predetermined loss limit. For example, a first buy in by the player of $100 subsequent to reaching a predetermined loss limit would provide $95 worth of credits on the machine, a second buy in by the player of another $100 subsequent to reaching the predetermined loss limit would provide $90 worth of credits on the machine, and so on. Thus, repeated buy-ins would be buying the player less and less. At some point, the rate of return on the player's buy-ins could drop precipitously such as, a 50% return after five buy-ins by the player subsequent to reaching the predetermined loss limit (i.e., the player inputs $100 and is provided only $50 worth of credits). This embodiment would likely be highly successful in deterring continued wagering. In one less severe embodiment, the wagering game machine 10 may not "take" the aforementioned portion of the player's buy-in(s), but may simply kick it back to the player or hold it escrow for future play by the player following a predetermined lapse of time or satisfaction of some action by the player (e.g., collection by the player at a pay window).

In at least some other aspects of the present concepts, the gaming establishment may offer a benefit to the player (e.g., one exceeding a loss limit or otherwise engaging in irresponsible wagering) to move to another machine. For example, the wagering game machine 10 could provide a dollar for dollar buy in on a current machine (e.g., $100 input into the machine provides $100 in credits), but may offer the player a better ratio on another machine or table in the gaming establishment (e.g., $100 input into the alternative machine provides $105 in credits to be played on that machine). Thus, the player would be encouraged to get up and walk around. Hopefully, as the player walks around, they will have a brief period to think about whether they really want to wager more money.

In another aspect, the gaming-machine 10 or gaming establishment may make a telephone call to the player's spouse at a predetermined loss limit or at each one of a plurality of predetermined loss limits, at the request of a player. For example, if a player has just lost $500, and his predetermined loss limit was $500, the gaming establishment could, through an automated system, call the player's wife to play a message stating that "Your husband has just lost $500, Press (1) to permit him to continue gambling, Press (2) to prevent him from further wagering activity for 1 hour, Press (3) to prevent him from further wagering activity for 2 hours, Press (4) to prevent him from further wagering activity for 4 hours, Press (5) to prevent him from further wagering activity for 12 hours, Press (6) to prevent him from further wagering activity for 24 hours, or Press (7) to prevent him from further wagering activity for the duration of his stay.

In still another embodiment, the wagering game machine 10 may, for an identified player utilizing the player tracking identifier, deposit the aforementioned portion of the player's buy-in(s) in an investment vehicle for the player (e.g., a bank Certificate of Deposit, a Treasury Bond, a savings account, etc.) or for a related-person designated by the player, such as a parent, sibling, spouse or child, that would be provided to the player or other designated person at a future time (e.g., in one day, two days, a week, etc.).

In another variant of methods for promoting responsible gaming, a fee or tax structure for the gaming establishments may be altered to impose a sliding taxation, fee, or tariff scale. In accord with this concept, greater losses by a player would impose greater taxes or fees on the gaming establishment. For example, using a simplistic example, a gaming establishment might be taxed at a first rate (e.g., 20%) proceeds of a player losses for a first predetermined amount of player losses (e.g., $1000) and taxed at a second rate (e.g., 30%, 40%, 50%, 60%, 70%, etc.) proceeds of a player losses above the first predetermined amount of player losses (e.g., above $1000). Accordingly, in one embodiment, a method in accord with the present concepts could include the acts of tracking the player loss data or the associated gaming establishment take and then providing the player loss data or gaming establishment take data to a regulatory body on a per player basis or on an aggrandized basis identifying in total, the number of players exceeding the first predetermined amount of player losses and/or any subsequent predetermined amounts and the total of the player losses in each of the tiers of player losses. The time period for the losses could, for example, be reset each day so that a gaming establishment would be motivated to encourage a player from incurring losses above the limit on any given day and come back to play the following day. Alternatively, the loss limits may reflect hourly, daily, weekly, monthly, or yearly player losses (e.g., $1,000/day, $7,000/week, $12,000/month, etc.).

The wagering games may themselves be altered, in accord with at least some aspects of the present concepts, to promote responsible gaining. For example, upon the attainment of a predetermined condition (e.g., a loss limit), the wagering game machine 10 could move from a default configuration to a secondary configuration in which the player would need more symbols to trigger a feature. In one aspect, the same payback percentage would be maintained so that, although the payback percentage is same, it would make the game appear harder. For example, if you originally need three scattered symbols to trigger a game feature, the secondary configuration could require that the player obtain four scattered symbols. This change from the default configuration to a secondary configuration would be clearly communicated to the player and would, optionally, require the player to enter an input to verify that the player understands and accepts the change in configuration. In accord with this aspect, the player would actually have the exact same chance of getting the four scattered triggers to trigger the feature as he or she did getting the three scattered symbols before, but it appears to the player that it is more difficult to get four scattered symbols than three scattered symbols. Again, in this aspect, the odds are maintained, it just appears to the player that their odds are getting worse.

In at least some aspects, the wagering game may be altered to promote responsible gaming by, following the attainment of a predetermined condition (e.g. a loss limit), moving from a default configuration to a secondary configuration in which the bonus game or game feature is dressed down. For example, whereas a game feature might ordinarily show the progression of several free spins of a wheel, the secondary configuration could entirely omit the spinning of the wheels and just blankly give the player a result of the free spins. Thus, the wagering game machine 10 may effectively bypass the bonus game or game feature and provide the player with the ability to provide necessary inputs, if any are required, and output the net result. For example, if a player is supposed to pick one of six elements and the six elements are ordinarily displayed in entertaining graphics, the player may simply encounter a text box saying "Pick a number from one to six" or the like. In another example, an ordinarily colorful and vibrant game feature or bonus game might be rendered only in a reduced-color set, gray-scale or black and white. In another example, the resolution of at least a portion of the display (e.g., a part of the display, the entirety of the display, a portion of a window shown in the display, etc.) is reduced. In still another example, the sounds associated with the game might be reduced to rudimentary noises (e.g., beeps reminiscent early computer games). In general, the visual and/or audio components of the bonus game or game feature experience are removed, lessened, or altered so as to diminish the player's excitement in playing such bonus game or game feature.

Some other aspects of the present concepts for promoting responsible gaming include a wagering game machine 10 configured to provide a mandatory opportunity for the player to win back a portion of the wager through a bonus game including, but not limited to, instances where a player places a wager following the player's reaching a soft loss-limit (e.g., the player receives reminders, but is not entirely cut off from placing additional wagers). For example, if a player has exceeded the player's loss limit and the put in $100, the gaming establishment offers the player a chance to win a portion of the wager back, in the event of the player's loss, on a bonus game or the like. Essentially, the gaming establishment would be providing a loss rebate and the player would be provided some predetermined chance (e.g., a one in ten chance) of winning back a specified portion of the wager (e.g., 10%, 20%, etc.). In other embodiments, the player could be provided some predetermined chance (e.g., 5%, 10%, etc.) of winning back the entire lost wager. This embodiment is advantageously suited to a networked environment or a downloadable environment where the identity of the player is known to the gaming establishment. This feature provides the dual benefit of keeping the player occupied with non-wagering games and providing the player with an opportunity to take the wager, or portion thereof, that might be recovered and, for example, walk away from the wagering game machine.

Each of these embodiments and obvious variations thereof is contemplated as falling within the spirit and scope of the claimed invention, which is set forth in the following claims. For example, each of the above-described examples relating to wagering game machines cover methods, systems, and computer programs to perform the described functions. Further, where systems and machines may be described as being in electrical communication with one another, such electrical communication need not be continuous and electrical communication broadly includes both continuous and intermittent electrical communication or electrical connection as may be achieved by, for example, periodic transmission or burst transmission techniques (e.g., electrical communication) or switches (e.g., electrical connection). Further, although the examples provided herein refers generally to application of the concepts herein to a bonus game, the application of the present concepts is broadly applicable to any wagering game or any game associated with a wagering game, however it is characterized, including, but not limited to a bonus game, ancillary game, secondary game, and/or game feature. It is further to be understood that the present disclosure includes, without limitation, incorporation of all of the described actions, acts, steps, and methods expressly or impliedly described herein into a computer readable instruction set or program executable by the controller 34.

Still further, although the aforementioned methods and devices for tracking a player's wagering sessions has been described generally in relation to an example of a wagering session on a given wagering game machine, the present concepts also encompass the same concepts directed toward the broader environments of casino-based tracking and controls, cross-casino tracking and controls, and even territorial tracking and controls within a given jurisdiction or even across jurisdictions.

The present concepts also include the marrying of or relation of loss limits across multiple product categories and/or multiple technology platforms, even in disparate geographic locations. For example, various jurisdictions have shown a propensity to impose restrictions, if not outright bans, on uncontrolled wagering activities such as on-line gambling, such as the recently enacted "Unlawful Internet Gambling Enforcement Act of 2006." As governments or jurisdictions become increasingly concerned about problem gamblers and/or unregulated gambling, the presently disclosed concepts provide additional mechanisms (e.g., loss limits) by which abuses and untoward outcomes may be curtailed. As noted above, some jurisdictions have used loss limits to prevent gamblers who frequent gaming venues from spending too much money in a certain time period in those venues. However, the concept of loss limits, or other concepts disclosed herein, have not been integrated into on-line gambling platforms or other types of remote electronic gambling. For example, some UK-based websites allow players to log-on to their sites via either a mobile phone or computer using an account number, but such websites have not integrated the loss limit concept that regulators and governments have applied to conventional gaming machines.

Therefore, in accord with at least some aspects of the present concepts, the loss limit or other disclosed methods or devices for promoting responsible wagering game play are advantageously applied directly to the remote electronic node (e.g., an electronic device comprising responsible wagering software, firmware, etc.), and/or to intermediary and/or destination or termination nodes (e.g., computers, services, servers, layers, etc.) upon which aspects of the wagering game are verified, transmitted, determined, accounted, or stored. For example, a plurality of on-line accounts associated with a player may be linked together for purposes of responsible gaming. These accounts may comprise independent, separately funded player accounts associated with different websites or may comprise a central wagering financier (e.g., a credit organization, bank, credit card company, etc.). Thus, a player using a credit card for wagering activities may have voluntarily enable self-imposed limits on use for gambling or, alternatively, such potential wagering financier may unilaterally enact stop-loss or loss limit provisions for recognized wagering activity.

Still further, aspects of the present concepts apply not only separately to on-line wagering activities or to all potential wagering mediums including conventional gaming machines (e.g., slot machines, pachislots, skill with prizes (SWP) machines, amusement with prizes (AWP) machines, etc.) in physical gaming venues, such as casinos, but also extend to include combinations thereof. For example, the present concepts include carrying over loss limits, or other disclosed methods or devices for promoting responsible wagering game play, from physical casinos to all of the different form factors that can be used for a player to participate in a wagering game. Thus, the present concepts expressly include the tying of mobile, internet, interactive TV, and/or conventional gaming systems to a single account or an identifier linking plural accounts (e.g., a social security number, a driver's license number, a name, a code, etc.) for the purpose of ensuring the promotion of responsible gaming. This typing enables one or more player account(s) to be advantageously associated with one or more responsible gaming conditions to provide a check, transparent or visible, to player losses, regardless of the actual gambling medium(s) used by the player. Accordingly, loss limits can be enforced across all such mediums and prevent, for example, a player who loses a large sum in a casino from going home and losing more money beyond the predetermined (e.g., self-imposed or jurisdictionally-imposed) loss limits of the jurisdiction by playing on a casino site.

Thus, the present concepts provide, for example, a method for promoting responsible wagering game play comprising the acts of tracking a wagering loss relating to an account or linked accounts, triggering a wagering-restriction feature when the wagering loss exceeds a predetermined condition (e.g., a loss limit), and preventing wagers to be placed in association with such account until a reinstatement condition (e.g., a time period, a funding provision, etc.) has been satisfied. The account, or linked accounts, may be accessed through in any wagering platform, medium or activity, such as noted by way of example above. Likewise, the act of tracking a wagering loss may occur relative not to an account, but relative to a player identification number, an assigned or assumed code, a biometric input, or any other characteristic or information that may be related to a player to permit identification of the player and/or the player's source of funding to sufficiently inhibit or prevent irresponsible gaming. Such protections are available not only on one or more gaming establishment wagering game machines (e.g., 10, 110), but also on, in combination, or alternatively on, one or more non-gaming-establishment wagering game devices (e.g., cell phone, personal computer, etc., utilizing a communication pathway to access a wagering game server or service). Thus, responsible wagering protections may be provided in association with a player, one or more player-identifying characteristics or player-related information, and/or an account or accounts used by a player, across any wagering activities in which a player may engage.

In various aspects, any of the present concepts may be used in combination. For example, the responsible gaming methods and devices disclosed herein may adopt a tiered approach, with different conditions being imposed or actions taken upon different loss limits (e.g., an increasing severity and/or duration of limitations with increasing loss limits).

In accord with any of the present concepts disclosed herein which provide a message or information to a player, such message or information can be advantageously set up to interrupt a spin, a bonus, and or a wager input so that the player is made more likely to sit through or receive such message or information to see the result of their game or to continue wagering.

What is claimed is:

1. A gaming system configured to promote responsible wagering game play of a wagering game, the gaming system comprising:

one or more processors; and at least one memory device storing at least instructions that, when executed by the one or more processors, cause the one or more processors to operate with the at least one memory device to:

track and record wagers and wagering losses occurring on the gaming system, wherein the wagering losses are calculated by subtracting collective wagers placed by a player during a predetermined period from any payoffs awarded to the player during the predetermined period, monitor the wagering losses with respect to both a predetermined wagering loss limit and a predetermined wagering loss rate, and trigger a wagering-restriction feature on the gaming system in response to the wagering losses exceeding either of the predetermined wagering loss limit or the predetermined wagering loss rate.

2. The gaming system of claim 1, wherein the predetermined period is selected from one of an elapsed time, a single gaming session, a number of successive wagers, and a number of wagers placed since a previous payoff.

3. The gaming system of claim 1, wherein the wagering-restriction feature includes moving a gaming machine from a default configuration to a secondary configuration in which a wagering game at least appears to be more difficult to win than in the default configuration.

4. The gaming system of claim 1, wherein the wagering losses are linked to the player by tracking the wagering losses associated with a player tracking feature implemented on the gaming system.

5. The gaming system of claim 1, wherein the wagering-restriction feature causes the gaming system to reject a subsequent wager by the player to play one or more wagering games available on the gaming system.

6. The gaming system of claim 1, wherein the wagering-restriction feature alters at least one game-play aspect of one or more wagering games available on the gaming system.

7. The gaming system of claim 6, wherein the at least one game-play aspect includes at least one of adding an audible indicator and adding a visual indicator to the one or more wagering games to emphasize the wagering losses during game play.

8. The gaming system of claim 6, wherein altering the at least one game-play aspect includes reducing the speed of the at least one game play aspect.

9. The gaming system of claim 8, wherein the at least one game play aspect includes spinning one or more reels.

10. The gaming system of claim 8, wherein the at least one game play aspect includes a rate of play of the one or more wagering games.

11. The gaming system of claim 1, wherein the wagering and losses occur on a gaming machine on the gaming system, the gaming machine being connected for communication to the gaming system via a communications network.

12. The gaming system of claim 11, wherein the at least one memory device resides on a game server on the communications network.

13. A method of promoting responsible wagering game play on a gaming system, the method comprising:

tracking and recording, via one or more processors, wagers and wagering losses occurring on the gaming system, wherein the wagering losses are calculated by subtracting collective wagers placed by a player during a predetermined period from any payoffs awarded to the player during the predetermined period;

monitoring the wagering losses with respect to both a predetermined wagering loss limit and a predetermined wagering loss rate; and triggering a wagering restriction feature on the gaming system in response to the wagering losses exceeding either of the predetermined wagering loss limit or the predetermined wagering loss rate.

14. The method of claim 13, wherein the predetermined period is selected from one of an elapsed time, a single gaming session, a number of successive wagers, and a number of wagers placed since a previous payoff.

15. The method of claim 13, wherein the wagering-restriction feature includes moving a gaming machine from a default configuration to a secondary configuration in which a wagering game at least appears to be more difficult to win than in the default configuration.

16. The method of claim 13, wherein the wagering losses are linked to the player by tracking the wagering losses associated with a player tracking feature implemented on the gaming system.

17. The gaming system of claim 13, wherein the wagering-restriction feature causes the gaming system to reject a subsequent wager by the player to play one or more wagering games available on the gaming system.

18. The gaming system of claim 13, wherein the wagering-restriction feature alters at least one game-play aspect of one or more wagering games available on the gaming system.

19. The gaming system of claim 18, wherein the at least one game-play aspect includes at least one of adding an audible indicator and adding a visual indicator to the one or more wagering games to emphasize the wagering losses during game play.

20. A machine-readable, non-transitory medium including executable instructions that, when executed by a gaming system, cause the gaming system to perform a method comprising:

tracking and recording, via one or more processors, wagers and wagering losses occurring on the gaming system, wherein the wagering losses are calculated by subtracting collective wagers placed by a player during a predetermined period from any payoffs awarded to the player during the predetermined period;

monitoring the wagering losses with respect to both a predetermined wagering loss limit and a predetermined wagering loss rate; and triggering a wagering restriction feature on the gaming system in response to the wagering losses exceeding either of the predetermined wagering loss limit or the predetermined wagering loss rate.

21. The machine-readable medium of claim 20, wherein the predetermined period is selected from one of an elapsed time, a single gaming session, a number of successive wagers, and a number of wagers placed since a previous payoff.

22. The machine-readable medium of claim 20, wherein the wagering-restriction feature includes moving a gaming machine from a default configuration to a secondary configuration in which a wagering game at least appears to be more difficult to win than in the default configuration.

23. The machine-readable medium of claim 20, wherein the wagering losses are linked to the player by tracking the wagering losses associated with a player tracking feature implemented on the gaming system.

24. The machine-readable medium of claim 20, wherein the wagering-restriction feature causes the gaming system to reject a subsequent wager by the player to play one or more wagering games available on the gaming system.

25. The machine-readable medium of claim 20, wherein the wagering-restriction feature alters at least one game-play aspect of one or more wagering games available on the gaming system.

26. The machine-readable medium of claim 25, wherein the at least one game-play aspect includes at least one of adding an audible indicator and adding a visual indicator to the one or more wagering games to emphasize the wagering losses during game play.

27. A gaming machine configured to promote responsible wagering game play, the gaming machine comprising:

at least one input device for receiving a wager from a player;

one or more display devices for displaying images related to game play of a wagering game;

one or more processors; and at least one memory device storing instructions that, when executed by the one or more processors, cause the gaming machine to:

initiate the wagering game in response to receiving at least one wager, randomly generate a game outcome and, in response to the game outcome being a winning outcome, award the player one or more payoffs resulting from the winning outcome, track and record the at least one wager and wagering losses occurring on the gaming machine, wherein the wagering losses are calculated by subtracting collective wagers placed by the player during a predetermined period from any payoffs awarded to the player during the predetermined period, monitor the wagering losses with respect to both a predetermined wagering loss limit and a predetermined wagering loss rate, and trigger a wagering-restriction feature on the gaming machine in response to the wagering losses exceeding either of the predetermined wagering loss limit or the predetermined wagering loss rate.

28. The gaming machine of claim 27, wherein the predetermined period is selected from one of an elapsed time, a single gaming session, a number of successive wagers, and a number of wagers placed since a previous payoff.

29. The gaming machine of claim 27, wherein the wagering losses are linked to the player by tracking the wagering losses associated with a player tracking feature implemented on a gaming network.

30. The gaming machine of claim 27, wherein the wagering-restriction feature includes moving the gaming machine from a default configuration to a secondary configuration in which the wagering game at least appears to be more difficult to win than in the default configuration.

* * * * *